US009181056B2

(12) United States Patent
Pulugurtha et al.

(10) Patent No.: US 9,181,056 B2
(45) Date of Patent: Nov. 10, 2015

(54) MEDIA SENSING ACTUATORS AND RELATED METHODS OF USE AND MANUFACTURE

(71) Applicant: Xerox Corporation, Norwalk, CT (US)

(72) Inventors: Venkata Shankar Pulugurtha, Tamil Nadu (IN); Harish Vijaya Kumar, Tamil Nadu (IN); Pankaj Gupta, Tamil Nadu (IN)

(73) Assignee: XEROX CORPORATION, Norwalk, CT (US)

( * ) Notice: Subject to any disclaimer, the term of this patent is extended or adjusted under 35 U.S.C. 154(b) by 7 days.

(21) Appl. No.: 14/103,965

(22) Filed: Dec. 12, 2013

(65) Prior Publication Data

US 2015/0166281 A1 Jun. 18, 2015

(51) Int. Cl.

| | |
|---|---|
| ***B65H 1/04*** | (2006.01) |
| ***B65H 7/20*** | (2006.01) |
| ***B65H 7/02*** | (2006.01) |

(52) U.S. Cl.

CPC .. *B65H 7/20* (2013.01); *B65H 1/04* (2013.01); *B65H 7/02* (2013.01); *B65H 2511/10* (2013.01); *B65H 2553/25* (2013.01); *B65H 2553/612* (2013.01)

(58) Field of Classification Search

CPC ..... B65H 1/00; B65H 1/04; B65H 7/02; B65H 31/20; B65H 2511/10; B65H 2553/25; B65H 2553/20; B65H 2553/612; B65H 2701/1131; B65H 7/20

USPC ..... 271/171

See application file for complete search history.

(56) References Cited

U.S. PATENT DOCUMENTS

| | | | | |
|---|---|---|---|---|
| 5,655,764 | A * | 8/1997 | Ota et al. | 271/171 |
| 5,927,707 | A * | 7/1999 | Miura | 271/171 |
| 2004/0047663 | A1* | 3/2004 | Yano | 399/389 |
| 2009/0051101 | A1* | 2/2009 | Yamagishi | 271/171 |
| 2009/0066011 | A1* | 3/2009 | Ohno et al. | 271/171 |
| 2010/0061785 | A1* | 3/2010 | Kimijima | 399/388 |
| 2010/0117291 | A1* | 5/2010 | Bridges et al. | 271/171 |
| 2012/0117814 | A1* | 5/2012 | Marumoto et al. | 33/555 |

* cited by examiner

*Primary Examiner* — David H Bollinger

(57) ABSTRACT

The present disclosure provides systems and methods for implementing a media sensing actuator for determining characteristics of a media stack including one or more medium located on an input unit. The media sensing actuator includes a switch and a bracket. The switch includes rotary members configured to drive an electronic circuit upon actuation. The bracket being biased to actuate the rotary members based on operative coupling with the media stack via at least one adjustment member on the input unit. The bracket is substantially curved.

21 Claims, 9 Drawing Sheets

| MEDIA SENSING LEVERS (204, 206) COUPLING TO FINGERS (218, 220) ON SIDE I | FINGERS (218, 220) COUPLING TO ROTARY STRIPS (216) ON SIDE II | |
|---|---|---|
| 206-1 TO 218-1 | 218-1 TO 216-1 | 12 |
| 206-2 TO 218-2 | 218-2 TO 216-2 | 14 |
| 206-3 TO 218-3 | 218-3 TO 216-3 | 16 |
| 204-2 TO 218-5 | 218-5 TO 216-5 | 18 |
| 204-1 TO 220 | (220 → 218-4) TO 216-4 | 20 |

MEDIA SENSING ACTUATORS AND RELATED METHODS OF USE AND MANUFACTURE

TECHNICAL FIELD

The presently disclosed embodiments relate to imaging apparatuses and related methods of use and manufacture, and more particularly relate to actuators for sensing media.

BACKGROUND

Related art imaging apparatuses, such as printers, may include two sets of mechanical assemblies to detect the size of media received on a media tray. A first mechanical assembly includes various types of guide members, brackets, levers, stoppers, etc., located on the media tray, which are adjusted for adapting to the length and width of the media received in the tray. Based on the media size, the components move to a distinct receiving position in the tray, and create a predetermined pattern of projections and depressions that are unique to that media size.

When the related art media tray is pushed into a tray slot in the printer, the first mechanical assembly triggers a unique set of media sensing levers that are located on the media tray or inside the tray slot. For example, the first mechanical assembly may trigger a first set of media sensing levers for a letter-sized paper, and a second set of sensing levers for a legal-sized paper. Although these sensing levers are evenly spaced, there is an inherent uneven-spacing between the group of levers corresponding to the length of the media and the group of levers corresponding to the width of the media.

The triggered sensing levers then activate a second mechanical assembly including switches, springs, shafts, metal parts, and plastic components, which in turn send signals to a printed circuit board (PCB) placed beneath this assembly. The second mechanical assembly involves a complex design, and can engage with only evenly-spaced sensing strips, and does not account for the uneven spacing. As a result, the second assembly uses a large number of parts to separately engage unevenly-spaced length sensing levers and width sensing levers. This causes a significant increase in assembly time, manufacturing complexity and cost of the printer. It may, therefore, be advantageous to provide a simple and cost-effective mechanical assembly for detecting the media size.

SUMMARY

The present disclosure discloses a media sensing actuator for determining characteristics of a media stack including one or more media located on an input unit. The media sensing actuator includes a switch and a bracket that is substantially curved. The switch includes one or more rotary members configured to drive an electronic circuit upon actuation. The bracket being biased to actuate the rotary members based on operative coupling with the media stack through at least one adjustment member on the input unit. The bracket further includes multiple fingers and an auxiliary finger. One of the multiple fingers is coupled to the auxiliary finger. The bracket and the switch are together mounted on a frame.

Other and further aspects and features of the disclosure will be evident from reading the following detailed description of the embodiments, which are intended to illustrate, not limit, the present disclosure.

DETAILED DESCRIPTION

The following detailed description is made with reference to the figures. Exemplary embodiments are described to illustrate the disclosure, not to limit its scope, which is defined by the claims. Those of ordinary skill in the art will recognize a number of equivalent variations in the description that follows.

Exemplary Embodiments

Figure 1A:
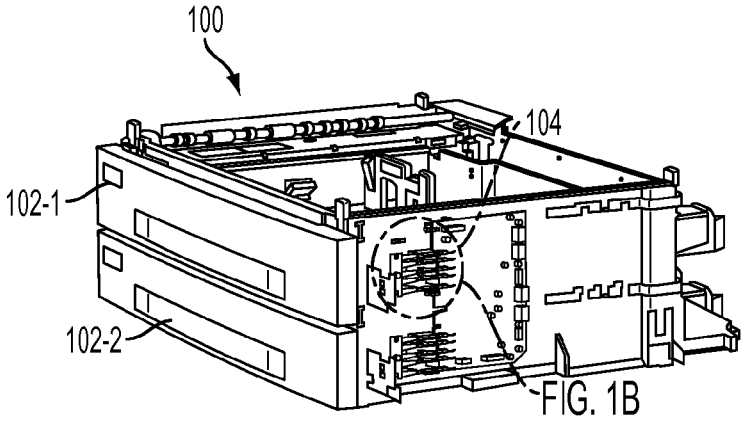
FIG. 1A is a perspective view of conventional media trays including a typical first media sensing actuator assembly for an imaging apparatus.

FIG. 1A illustrates a conventional media tray including a typical first media sensing actuator assembly for an imaging apparatus. The imaging apparatus (not shown), such as printers, scanners, photocopiers, integrated imaging devices, and so on, may include a media input unit 100 in communication with a variety of components, such as guide members, rollers, levers, and stoppers. Various types and designs of media input units can be used, depending on the size of media and functional complexity of the imaging apparatus.

The media input unit 100 represents conventional media trays 102-1, 102-2 (collectively, media trays 102) for receiving a media stack including one or more medium. The terms "media", "medium", "input media", and "input medium" refer to physical sheets of paper, plastic, cardboard, or other suitable physical substrates that can pass through a media path associated with the imaging apparatus. The imaging apparatus and the conventional media trays 102 include various other components and features that would be well understood by a person skilled in the art and that need not be elaborated here.

Each of the media trays 102 includes a platform (not shown) for receiving the media stack, two or more guide members (not shown), and a typical first media sensing actuator assembly 104. The guide members (not shown) are adjusted to move horizontally or vertically on the surface of the platform and are placed adjacent to edges of the media for temporarily and immovably securing the media received on the platform.

Figure 1B:
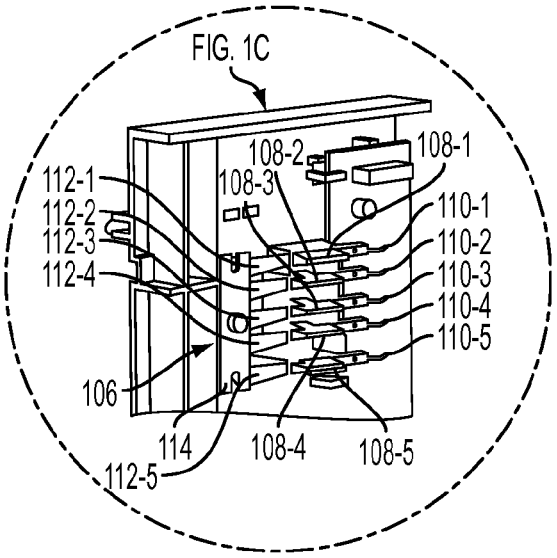
FIG. 1B is a perspective view of a portion of the typical first media sensing actuator assembly of FIG. 1A from a first side.
Figure 1C:
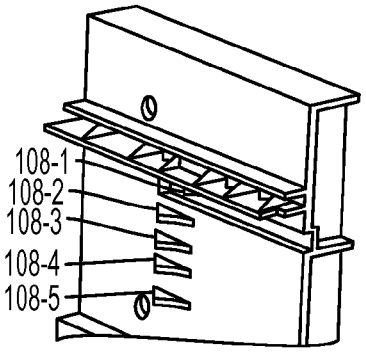
FIG. 1C is a perspective view of a portion of the typical first media sensing actuator assembly of FIG. 1A from a second side.

As shown in FIG. 1B, the typical first media sensing actuator assembly 104 includes a first finger panel 106, rear media sensing levers 108-1, 108-2, . . . , 108-5 (collectively, rear media sensing levers 108), and front media sensing levers 110-1, 110-2, . . . , 110-5 (collectively, front media sensing levers 110). The first finger panel 106 is substantially flat and is made of any electrically conductive material known in the art. The first finger panel 106 has evenly spaced fingers 112-1, 112-2, . . . , 112-5 (collectively, fingers 112), each extending from a rectangular plate 114. The fingers 112 are restrictively flexible about the point of connection with the rectangular plate 114 and are of relatively same length. Each of the fingers 112 is removably engaged with the corresponding front media sensing levers 110, which are connected to an electronic circuit (not shown). The electronic circuit is configured to detect the media stack and determine media stack characteristics based on actuation of the front media sensing levers 110. Examples of media stack characteristics include, but are not limited to, length, width, height, location on the tray, media type, pre-printed codes, etc. On the other hand, the rear media sensing levers 108 are mounted on the fingers 112 and extend towards slots (not shown) in the imaging apparatus where the conventional media trays 102 are received (FIG. 1C).

Figure 1D:
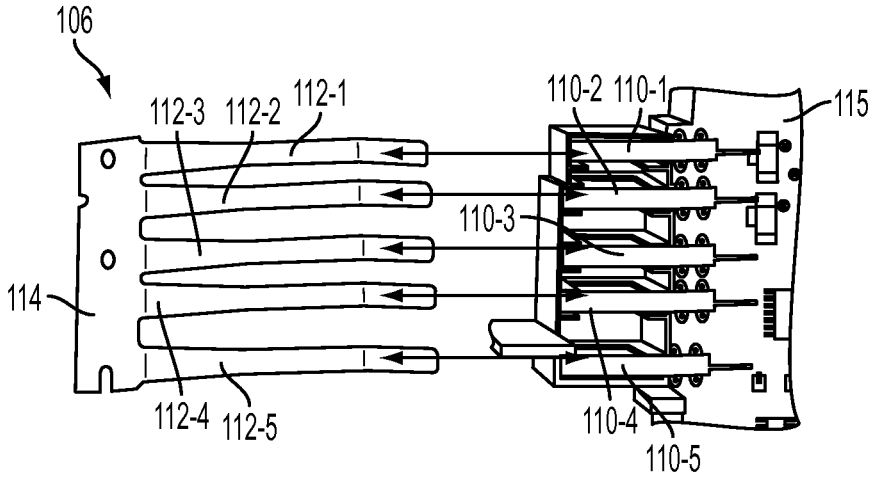
FIG. 1D illustrates operational relationship between components of the typical first media sensing actuator assembly of FIG. 1A.

FIG. 1D illustrates operational relationship between components of the typical media sensing assembly of FIG. 1A. The conventional media tray, such as the tray 102-1, includes one or more sensing strips (not shown) corresponding to at least one of the guide members, which is either oriented along the length or width of the media stack. Each sensing strip includes one or more cutouts (not shown), which are unevenly spaced from each other. These cutouts are aligned to and engaged with the typical first media sensing actuator assembly 104 through various intermediate structures or components (not shown) such as angled-panels, or micro-levers in the actuator assembly 104 for allowing detection of the received media stack and its characteristics. As such, the first media sensing actuator assembly 104 involves significant manufacturing, installation, and/or maintenance complexity as well as increases effective cost of the imaging apparatus.

In a non-working position when the conventional media tray 102-1 is not inserted into the imaging apparatus, the fingers 112 of the first finger panel 106 are engaged with the front media sensing levers 110, which is movably mounted over an electronic circuit such as the electronic circuit 115. In a working position when the conventional media tray 102-1 is inserted within the imaging apparatus, the cutouts engage with and actuate a specific set of rear media sensing levers 108. The actuated rear media sensing levers 108 then push the corresponding fingers 112 of the first finger panel 106 away from the front media sensing levers 110. For example, the actuated rear media sensing levers 108 may disengage the fingers 112-2 and 112-4 from the corresponding front media sensing levers 110-2, 110-4. Such disengagement of the fingers 112 is detected by the electronic circuit for determining the media stack characteristics. Such repeated back and forth movement of the fingers 112 may cause extensive wear and tear of the first finger panel 106 over time.

Figure 1E:
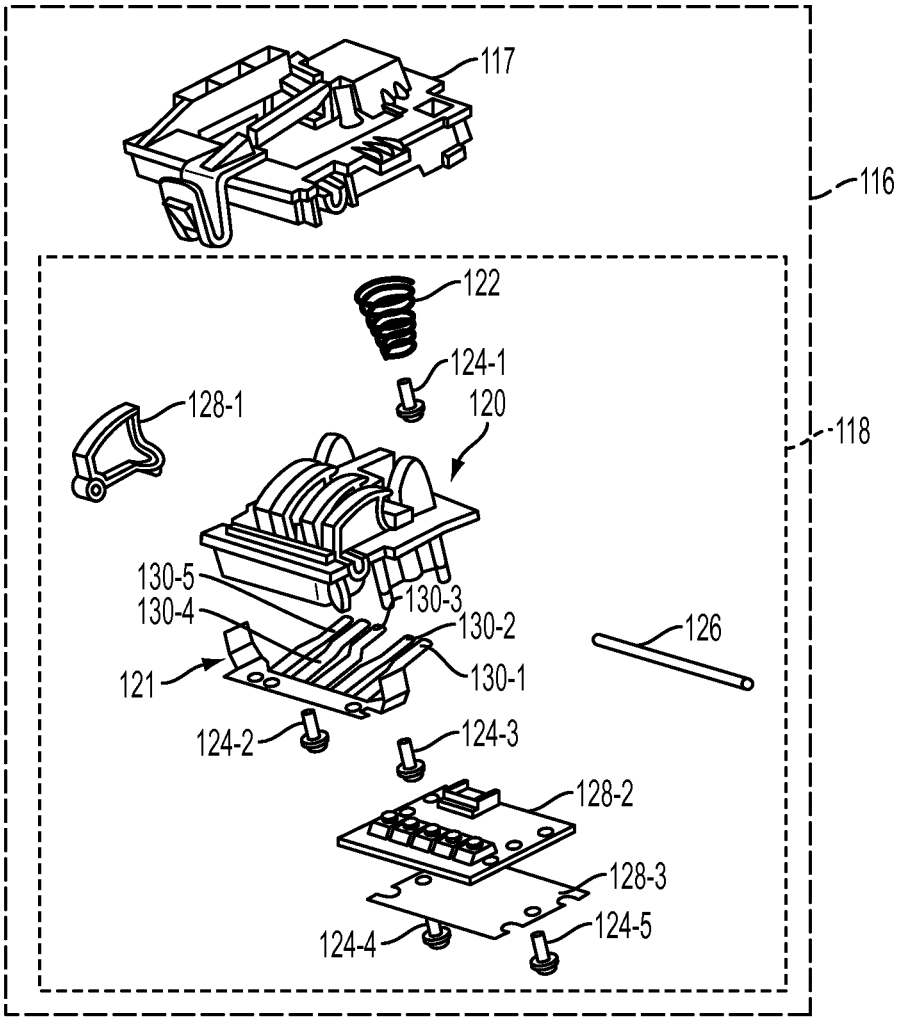
FIG. 1E is an exploded view of a typical second media sensing actuator assembly.

FIG. 1E is an exploded view of the typical second media sensing actuator assembly 116. As illustrated, the typical second media sensing actuator assembly 116 includes a frame 117 and a typical media sensing actuator 118 that has an integrated switch 120, a second finger panel 121, and other peripheral parts such as a spring 122, screws 124-1, 124-2, . . . 124-5 (collectively, screws 124), a shaft 126, and coupling members 128-1, 128-2, 128-3. The second finger panel 121 is substantially similar to the first finger panel 106 and includes fingers 130-1, 130-2, . . . , 130-5 (collectively, fingers 130). A first set of fingers 130-1, 130-2 and a second set of fingers 130-3, 130-4, 130-5 are evenly spaced. However, in contrast to the fingers 112 in the first finger panel 106, the first set of fingers 130-1, 130-2 are relatively unevenly spaced from the second set of fingers 130-3, 130-4, 130-5. The fingers 130-1, 130-2 may couple to media length sensing levers (discussed later in the description of FIG. 3A) and the fingers 130-3, 130-4, 130-5 may couple to media width sensing levers (discussed later in the description of FIG. 3A) located on a media tray. The fingers 130 of the second finger panel 121 require a sophisticated design of the integrated switch 120 to actuate an electronic circuit based on actuation of the second finger panel 121. Additionally, the switch 120 and the second finger panel 121 are mounted over the frame 117 using the peripheral parts for assembling the media sensing actuator 118. Such large number of components and peripheral parts, as well as the sophisticated integrated switch 120 increase the manufacturing, installation, and/or maintenance complexity, overall assembly time, and effective cost of the imaging apparatus when the typical media sensing actuator 118 is employed to interface between the guide members and the electronic circuit.

Figure 2:
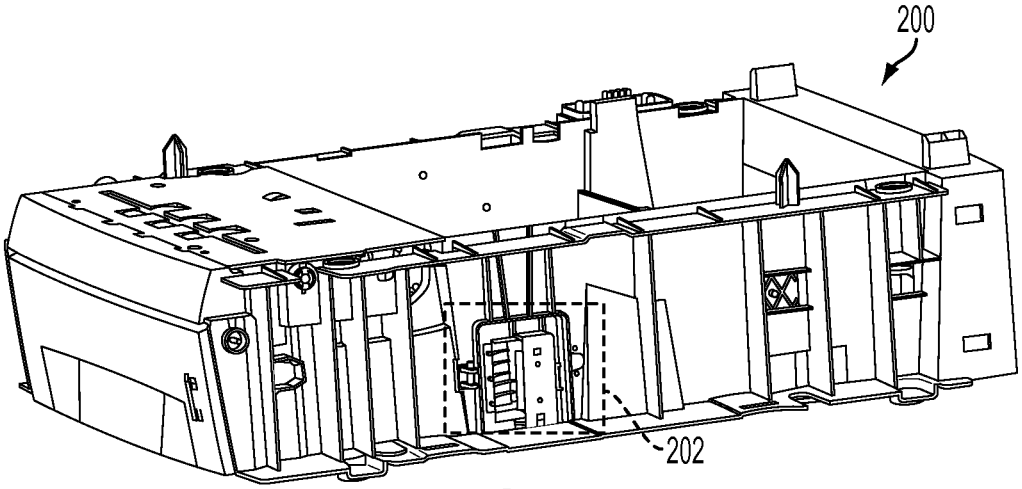
FIG. 2 is a perspective view of a media tray including an exemplary media sensing actuator assembly for an imaging apparatus.

FIG. 2 illustrates a media tray including an exemplary media sensing actuator assembly for an imaging apparatus. A media tray 200 includes a platform (not shown) for receiving a media stack including one or more medium and two or more guide members (not shown), which operate in a manner discussed above. Unlike the conventional media trays 102, the media tray 200 includes length sensing levers and width sensing levers, discussed later in greater detail, each coupled to at least one of the guide members.

In an embodiment, a media sensing actuator assembly 202 is mounted on the media tray 200. A first side of the actuator assembly 202 is configured to communicate with the guide members via the sensing levers on the media tray 200, and a second side is in communication with an electronic circuit on the imaging apparatus, wherein the electronic circuit is configured to detect the media stack and determine media stack characteristics. Alternatively, instead of the media tray 200, the media sensing actuator assembly 202 may be located on the imaging apparatus body (not shown).

When the media tray 200 is inserted or positioned within the imaging apparatus, the sensing levers engage with the media sensing actuator assembly 202 to allow determination of the media stack characteristics. The media sensing actuator assembly 202 may be appropriately dimensioned to be accommodated into the imaging apparatus.

Figures 3A, 3E:
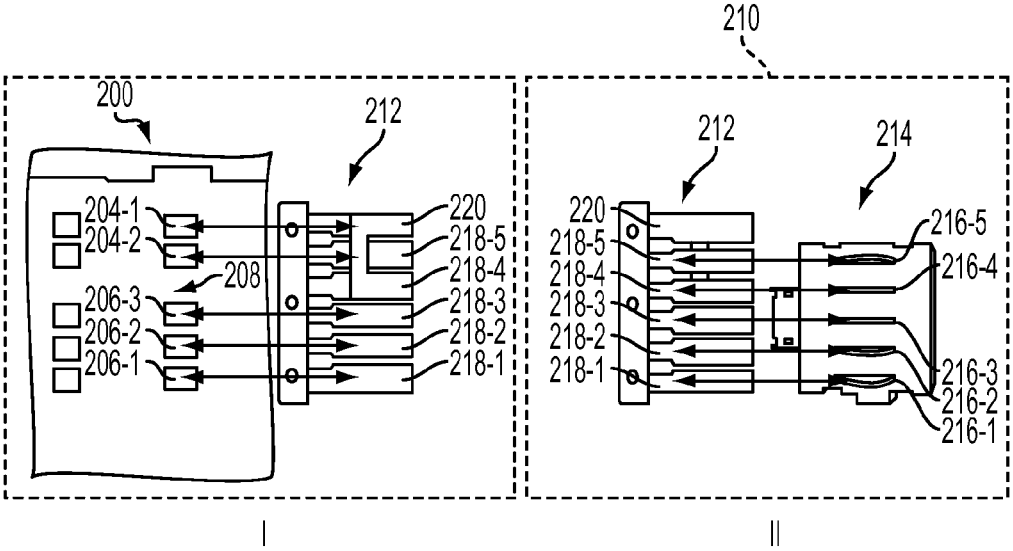
FIG. 3A is a schematic of an exemplary operational relationship between the media tray and the media sensing actuator assembly of FIG. 2.
FIG. 3E illustrates operational coupling between compounds of the media tray and the media sensing actuator assembly of FIG. 2.

FIG. 3A is a schematic of an exemplary operational relationship between the media tray 200 and the media sensing actuator assembly 202 of FIG. 2. The media sensing actuator assembly 202 includes a media sensing actuator 210 and a frame (not shown), discussed later in detail. The media sensing actuator 210 includes a bracket 212 and an electromechanical switch 214, both mounted on the frame. Unlike the typical media sensing actuator assemblies 104 and 116, since the media sensing actuator assembly 202 includes minimal number of components, i.e., three, effective cost and design complexity of the media sensing actuator assembly 202 are significantly reduced. On a first side I, the bracket 212 is in communication with the media tray 200 and is in communication with the switch 214 on a second side II.

The media tray 200 may include length sensing levers 204-1, 204-2 (collectively, length sensing levers 204), and width sensing levers 206-1, 206-2, 206-3 (collectively, width sensing levers 206). The length sensing levers 204 are in communication with a first set of guide members (not shown) that may be adjusted along the length of the media stack to designate the width of the media stack. The width sensing levers 206 are in communication with a second set of guide members (not shown) that may be adjusted along the width of the media stack to designate the length of the media stack. The length sensing levers 204 have even pitched spacing between them. Similarly, the width sensing levers 206 have even-pitched spacing amongst them. However, the length sensing levers 204 are relatively unevenly pitched from the width sensing levers 206. This uneven spacing 208 is maintained to accommodate various components, such as rollers, diverters, brackets, shafts, etc., of the media tray 200. In order to interface the media sensing levers, such as the levers 204, 206, with the electronic circuit (not shown), related art media sensing actuator assemblies 104, 116 are complex in design, manufacturing, installation, and/or maintenance. The media tray 200 may optionally include height sensing levers (not shown), which are in communication with a third set of guide members (not shown) that may be adjusted along the height of the media or media stack to designate the respective height of media or media stack.

The switch 214 includes rotary strips 216-1, 216-2, . . . , 216-5 (collectively, rotary strips 216), which engage with the electronic circuit when the bracket 212 transitions from a non-working position X to a working position Y, discussed below in greater detail. In the non-working position X, the bracket 212 is located adjacent to the rotary strips 216 and is capable of rotating the rotary strips 216. The bracket 212 is configured to transform linear movement of the media tray 200 into rotary motion of strips 216 of the switch 214 upon actuating the switch 214 by the sensing levers 204, 206 via the bracket 212. Optionally, the switch 214 may also be actuated by the height sensing levers via the bracket 212. The bracket 212 may be made of a variety of existing, related art, or later developed conductive materials including, but not limited to, metals, polymers, and alloys.

The bracket 212 includes multiple fingers 218-1, 218-2, . . . , 218-5 (collectively, fingers 218) and an auxiliary finger 220, which are driven by the sensing levers 204, 206 protruding from the media tray 200. The number of fingers 218 may be equivalent to the total number of sensing levers 204, 206, and the number of auxiliary fingers, such as the auxiliary finger 220, may be equivalent to the number of uneven-pitched spacings, such as the spacing 208. As shown, the fingers 218 and the auxiliary finger 220 are in communication with the sensing levers 204, 206 of the media tray 200 on the first side I and with the rotary strips 216 of the switch 214 on the second side II. Both the fingers 218 and the auxiliary finger 220 are configured to operatively transfer actuation of the sensing levers 204, 206 to rotate the rotary strips 216 of the electromechanical switch 214. Such transfer of actuation is described in FIG. 3E, which illustrates operational coupling between components of the media tray 200 and the media sensing actuator 210. Referring to rows 12, 14, 16, and 18 of FIG. 3E, the sensing levers 206-1, 206-2, 206-3, 204-2 are coupled to the respective fingers 218-1, 218-2, 218-3, 218-5, which operatively transfer actuation of the sensing lever 206-1, 206-2, 206-3, 204-2 to rotate the rotary strips 216-1, 216-2, 216-3, 216-5, respectively. Referring to row 20 of FIG. 3E, the sensing lever 204-1 is coupled to the auxiliary finger 220. Instead of coupling directly with the rotary strip 216-4, the auxiliary finger 220 couples to the finger 218-4. The finger 218-4 operatively transfers actuation of the sensing lever 204-1 to rotate the rotary strip 216-4 of the electromechanical switch 214.

The above disclosure relating to the coupling between the fingers 218 and 220, and interactions of these fingers 218, 220 with: (1) the sensing levers 204, 206, and (2) the unevenly pitched spacing 208, is merely provided for exemplary purposes and is not intended to be limiting. A person of skill in the art will understand that various other suitable arrangements of the fingers 218, 220 can be contemplated for operative communication between the sensing levers 204, 206, height sensing levers, metal bracket 212, and the switch 214.

Figure 3B:
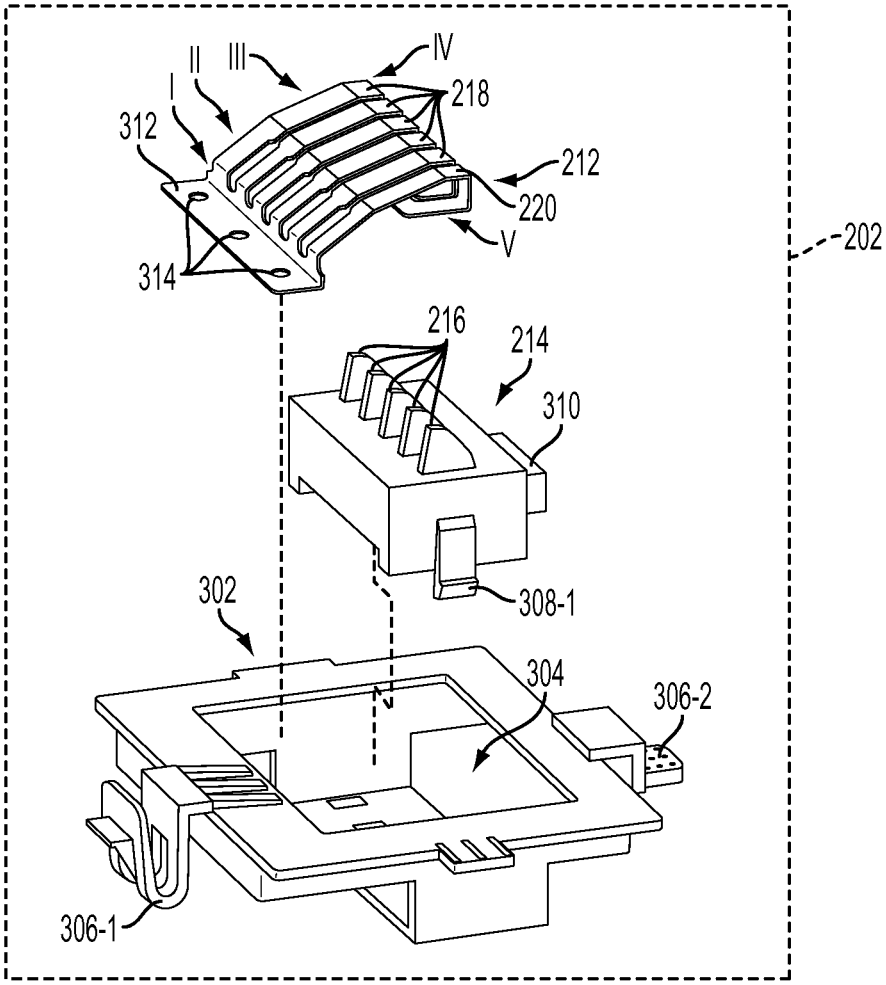
FIG. 3B is an exploded view of the exemplary media sensing actuator assembly of FIG. 2.

FIG. 3B is an exploded view of an exemplary media sensing actuator assembly, according to an exemplary embodiment. In the illustrated embodiment, the media sensing actuator assembly 202 includes a frame 302, the electromechanical switch 214, and the bracket 212, each may be manufactured separately and then assembled together. Alternatively, the switch 214 may be integrated with the frame 302 and manufactured as a single unit. The bracket 212 may be then mounted over the unit to form the media sensing actuator assembly 202. Such a modular approach to removably assemble various components, i.e., the frame 302, the electromechanical switch 214, and the bracket 212, allows for easy replacement in case any of these components become faulty. The switch 214 and the frame 302 may be made of a variety of same or different existing, related art, or later developed materials including, but not limited to, metals, polymers, and alloys.

The frame 302 may be manufactured to have a rigid body adapted to be removably installed into the media tray 200 or any other suitable location on the imaging apparatus. The frame 302 may include one or more slots 304 to receive the switch 214 and the bracket 212. Along the edges, the frame 302 includes one or more arms, such as arms 306-1, 306-2 (collectively, coupling arms 306), configured to secure the frame 302 onto the media tray 200, or alternatively at any suitable portion on rest of the imaging apparatus, by any suitable coupling mechanisms. Examples of these mechanisms include, but are not limited to, snap fit, screw fit, adhesives, or other known, related art or later developed attachment mechanisms. Unlike the typical media sensing actuator assemblies 104 and 116, the design of the frame 302 avoids use of fasteners for receiving the switch 214 and the bracket 212, or for securing the frame 302 on the imaging apparatus for achieving the intended purpose in the intended environment.

The electromechanical switch 214 is a rotary switch, which includes one or more coupling arms such as a coupling arm 308-1 for securing the switch 214 into the slot 304 of the frame 302. The switch 214 further includes an electrical contact 310 for receiving at least one connector of a cable harness that couples the switch 214 to an electronic circuit (not shown). Within the frame 302, the switch 214 is removably secured by any suitable known, related art or later developed coupling mechanisms. For example, the switch 214 may include positioning members 307 to position the switch 214 into the frame 302 and the coupling arms 308-1, 308-2 that may secure the switch 214 within the frame 302 through a snap fit (FIG. 3D). The electromechanical switch 214 includes one or more rotary strips 216, which are slightly semi-circular in shape and extend outwards from the surface of a first side of the switch 214. The remaining portions of the strips 216 reside adjacent to a binary encoder (not shown) within the switch 214. The binary encoder is in communication with one or more electrical contacts, such as the electrical contact 310, exposed to the ambient surroundings from a second side of the switch 214. The electrical contact 310 is configured to send activation signals to the electronic circuit when the media tray 200 in pushed within the imaging apparatus.

Figure 3C:
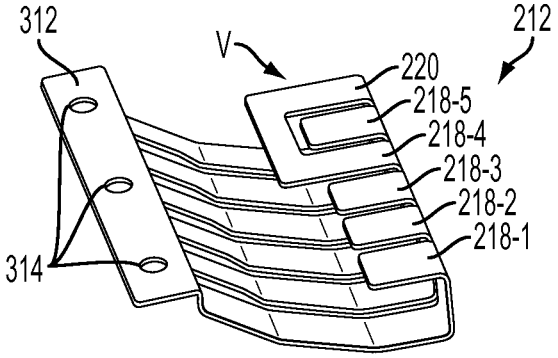
FIG. 3C is an enlarged schematic of an exemplary inverted bracket of the media sensing actuator assembly of FIG. 3B.
Figure 3D:
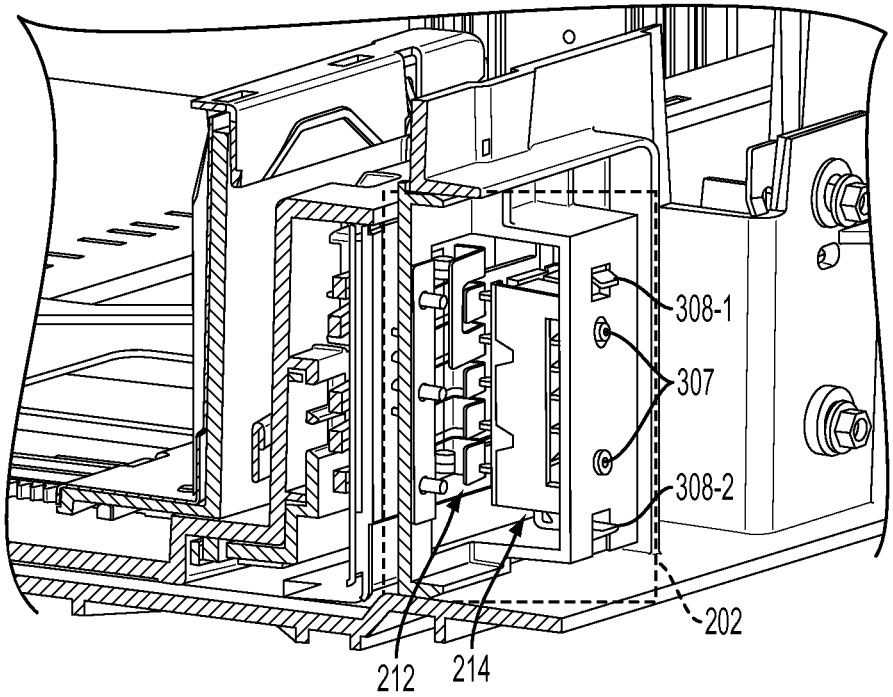
FIG. 3D is a schematic of an exemplary engagement between the bracket of FIG. 3C with a switch in the media sensing actuator assembly of FIG. 2.

Further, as shown in FIGS. 3B and 3C, the bracket 212 may include a flat panel 312 having one or more openings 314 (optional), each capable of being received into structural features of the frame 302 for retaining the bracket 212 into the slot 304. Extending from the flat panel 312, the bracket 212 may include two or more fingers 218, 220 having reasonable degree of even separation, which introduces electrical insulation between the fingers 218, 220. The separation additionally makes the bracket 212 relatively lighter for easy movement during operation. As discussed above, the bracket 212 includes fingers 218, 220, which may be sub-divided into multiple sections. Unlike the conventional finger panels 106 and 121, these multiple sections together acquire a substantially curved profile for flexibility. In an embodiment, the bracket 212 may include five sections, each configured to perform a particular function, such that the fingers 218, 220 originate in a first section I and terminate in a fifth section V in a predetermined arrangement.

The first section I of the bracket 212 is adjacent and connected to the flat panel 312, which is affixed to the frame 302, for example, using snap fit. The first section I provides rigidity to the bracket 212 during operation. The first section I extends to a second section II, which drives a retractable force on the subsequent bracket 212 sections when the orientation of the subsequent sections is altered. Adjacent to the second section II, a third section III is located that engages with the protruding sensing levers 204, 206, or optionally the height sensing levers, to bend the succeeding sections for activating the switch 214. The fourth section IV bends perpendicular to the third section III and supports the fifth section V, which is parallel to the third section III and perpendicular to the fourth section IV. The fifth section V is located over an axis transverse to the length of the flat panel 312 and, upon actuation, engages with the rotary strips 216 of the switch 214.

In the fifth section V, the fingers 218 are configured to engage with the rotary strips 216 of the switch 214. The fingers 218 are arranged to communicate with the rotary strips 216. In an embodiment, the rotary strip 216-4 is aligned in front of the spacing 208 between the sensing levers 204, 206 instead of being in front of the sensing lever 204-2 due to difference in orientation and sizes of the sensing levers 204, 206 and the switch 214. The rotary strips 216 are relatively smaller in size than the fingers 218, 220. Thus, the auxiliary finger 220 (in communication with sensing lever 204-1) and the finger 218-4 (in communication with the spacing 208) are operatively coupled to translate actuation of the sensing lever 204-1 to the rotary strip 216-4 (FIG. 3C).

When the bracket 212 is biased towards the switch 214, the rotary strips 216 pivot into the switch 214 surface about the center of a hypothetical circle formed by the semicircular strips 216. The inward pivoted strips 216 communicate with a binary decoder (not shown) through the electrical contact 310 and change the effective resistance value of the binary decoder for providing a unique binary signal to the electronic circuit through a cable (not shown). The electronic circuit determines the media stack characteristics based on the received binary signal.

Figure 4:
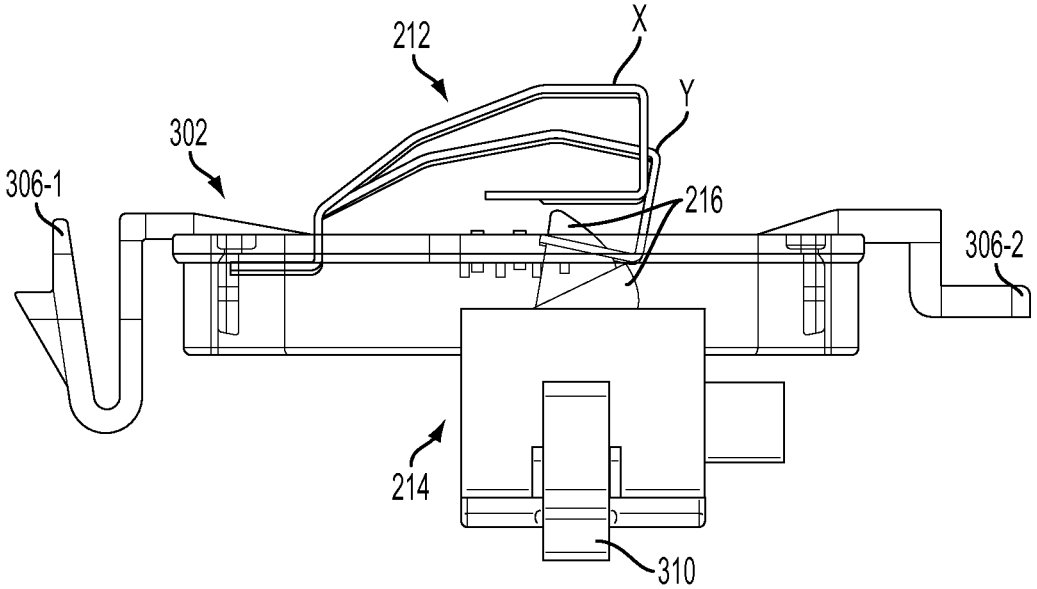
FIG. 4 illustrates an exemplary method of implementing the media sensing actuation assembly of FIG. 2.

FIG. 4 illustrates an exemplary method of implementing the media sensing actuator assembly of FIG. 3A that is integrated within the imaging apparatus. During operation, a media stack including one or more input medium, such as a paper, may be fed to the imaging apparatus through the media tray 200. The fed media stack is secured within the media tray 200 by placing the guide members along the length, width, and height of the media stack. Based on the media stack size, the guide members (not shown) may be adjusted to appropriately position the media stack within the media tray 200. In an embodiment, the adjusted guide members actuate a specific set of sensing levers 204, 206 on the media tray 200 to drive the levers 204, 206 outwards. For example, for the A4-size sheet, the adjusted guide members may make the sensing levers 204-1 and 206-2 protrude outwards and press against the bracket 212. The protruding levers 204-1 and 206-2 may get biased towards the respective fingers 220 and 218-2, both of which in turn bend towards the electromechanical switch 214. Additionally, the finger 218-4 may bend towards the switch 214 due to operative coupling between the auxiliary finger 220 and the finger 218-4. Collectively, the fingers 218-2, 218-4, 220 may drive the bracket 212 into the working position Y.

In the working position Y, a set of fingers 218 may press against the respective rotary strips 216 that may then actuate the electronic circuit. For example, the fingers 218-4, 218-2 may press against respective rotary strips 216-4, 216-2 due to difference in sizes of the bracket 212 and the switch 214 for actuating the switch 214. Upon actuation, the rotary strips 216-4, 216-2 are driven into the switch 214 to alter its effective resistance, indicative of the specific dimensions of the media stack, communicated to the electronic circuit via the electrical contact 310 of the switch 214. Media stack characteristics for any other media dimensions may be determined in a similar fashion.

Although the media sensing actuator assembly 202 has been explained with respect to a printer, it will be well understood by a person skilled in the art that the actuator assembly 202 can be incorporated or otherwise used with other imaging apparatuses such as a scanner, photocopier, integrated imaging device, and facsimile machine.

The above description does not provide specific details of manufacture or design of the various components. Those of skill in the art are familiar with such details, and unless departures from those techniques are set out, techniques, known, related art or later developed designs and materials should be employed. Those in the art are capable of choosing suitable manufacturing and design details.

The terminology used herein is for the purpose of describing particular embodiments only and is not intended to be limiting of the disclosure. It will be appreciated that several of the above-disclosed and other features and functions, or alternatives thereof, may be combined into other systems or applications. Various presently unforeseen or unanticipated alternatives, modifications, variations, or improvements therein may subsequently be made by those skilled in the art without departing from the scope of the subject matter as encompassed by the following claims.

What is claimed is:

1. A media sensing actuator for determining characteristics of a media stack including one or more medium, the media sensing actuator comprising:

a switch including one or more rotary members configured to drive an electrical contact upon actuation; and a bracket, configured to be in communication with the media stack, being biased to actuate the one or more rotary members based on operative coupling with the switch, wherein the bracket is substantially curved.

2. The media sensing actuator of claim 1, wherein the bracket is configured to move to a working position, wherein the bracket includes at least one section, at the working position, being biased to actuate the one or more rotary members.

3. The media sensing actuator of claim 2, wherein the at least one section is substantially curved towards an axis of the bracket that is transverse to a length of the bracket.

4. The media sensing actuator of claim 1, wherein the characteristics of the media stack include at least one of length, width or height of the media stack.

5. The media sensing actuator of claim 1, wherein the bracket includes a plurality of fingers and an auxiliary finger, wherein at least one of the plurality of fingers is coupled to the auxiliary finger.

6. The media sensing actuator of claim 1, wherein the bracket is made of a conductive material.

7. The media sensing actuator of claim 1, further comprising a frame, wherein the bracket and the switch are together mounted on the frame.

8. A media sensing actuator assembly in communication with a media stack including one or more medium, the assembly comprising:

a bracket including a plurality of fingers and an auxiliary finger, at least one of the plurality of fingers being coupled to the auxiliary finger;

a switch including one or more rotary members capable of communicating with at least one finger among the plurality of fingers based on biasing of the bracket; and a frame configured to secure the switch and the bracket.

9. The media sensing actuator assembly of claim 8, wherein the plurality of fingers is substantially separated from each other.

10. The media sensing actuator assembly of claim 8, wherein the bracket is curved.

11. The media sensing actuator assembly of claim 8, wherein the bracket is configured to swing about an axis of the bracket that is transverse to a length of the bracket.

12. The media sensing actuator assembly of claim 11, wherein the plurality of fingers and the auxiliary finger extend from the axis of the bracket that is transverse to the length of the bracket.

13. The media sensing actuator assembly of claim 11, wherein a portion of the bracket, which provides coupling between the at least one finger and the auxiliary finger, is substantially curved towards the axis of the bracket that is transverse to the length of the bracket.

14. The media sensing actuator assembly of claim 8, wherein the bracket is made of a conductive material.

15. The media sensing actuator assembly of claim 8, wherein the one or more rotary members communicate with an electrical contact circuit upon actuation by the plurality of fingers.

16. The media sensing actuator assembly of claim 8, wherein the bracket is mounted over the switch.

17. A system for detecting a media stack including one or more medium and for use with an electrical contact, the system comprising:

an input unit configured to receive the media stack; and a media sensing actuator including:

a switch including one or more rotary members configured to drive the electrical contact upon actuation; and a bracket, in communication with the media stack, being biased to actuate the rotary members based on operative coupling with the switch, wherein the bracket is substantially curved.

18. The system of claim 17, wherein the media stack characteristics include at least one of length, width or height of the media stack.

19. The system of claim 17, wherein the bracket includes a plurality of fingers and an auxiliary finger, wherein at least one of the plurality of fingers is coupled to the auxiliary finger.

20. The system of claim 17, wherein the bracket is made of a conductive material.

21. The system of claim 17, further comprising a frame, wherein the bracket and the switch are together mounted on the frame.

* * * * *